US007331120B2

(12) United States Patent
Scherb et al.

(10) Patent No.: US 7,331,120 B2
(45) Date of Patent: Feb. 19, 2008

(54) THROUGHFLOW CYLINDER

(75) Inventors: Thomas Thoröe Scherb, Sao Paulo (BR); Harald Schmidt-Hebbel, Barueri (BR)

(73) Assignee: Voith Paper Patent GmbH, Heidenheim (DE)

( * ) Notice: Subject to any disclaimer, the term of this patent is extended or adjusted under 35 U.S.C. 154(b) by 279 days.

(21) Appl. No.: 10/712,608

(22) Filed: Nov. 13, 2003

(65) Prior Publication Data

US 2004/0216323 A1 Nov. 4, 2004

Related U.S. Application Data

(63) Continuation of application No. PCT/EP02/04987, filed on May 6, 2002.

(30) Foreign Application Priority Data

May 16, 2001 (DE) ..... 101 23 809

(51) Int. Cl.
*F26B 11/02* (2006.01)

(52) U.S. Cl. ..... 34/640; 34/629; 34/639

(58) Field of Classification Search ..... 34/618, 34/623, 624, 629, 639, 640; 165/89, 90
See application file for complete search history.

(56) References Cited

U.S. PATENT DOCUMENTS

| | | | | |
|---|---|---|---|---|
| 2,887,964 | A * | 5/1959 | Griner | 425/289 |
| 3,122,505 | A * | 2/1964 | Rulon-Miller et al. | 508/104 |
| 3,139,375 | A | 6/1964 | Bryand | 162/371 |
| 4,050,131 | A | 9/1977 | Bryand | 29/121.3 |
| 4,625,430 | A * | 12/1986 | Aula et al. | 34/116 |
| 5,766,120 | A | 6/1998 | Schmitz | 492/26 |
| 5,985,073 | A * | 11/1999 | Kimura et al. | 156/188 |
| 6,253,671 | B1 | 7/2001 | Kayser | 100/35 |
| 6,332,996 | B1 * | 12/2001 | Dit Picard et al. | 264/280 |
| 6,472,028 | B1 * | 10/2002 | Frazzita et al. | 427/494 |
| 6,487,789 | B1 * | 12/2002 | Wolf et al. | 34/114 |

FOREIGN PATENT DOCUMENTS

| | | |
|---|---|---|
| DE | 26 40 530 | 3/1978 |
| DE | 44 45 471 | 12/1995 |
| EP | 0 315 961 | 5/1989 |
| EP | 0 363 887 | 4/1990 |
| EP | 1 098 034 | 5/2001 |

OTHER PUBLICATIONS

"Hightech Durchströmtrocknung für Tissue" of Fleissner GmbH in ipw Mar. 2001, p. 21.

* cited by examiner

*Primary Examiner*—Jiping Lu
(74) *Attorney, Agent, or Firm*—Taylor & Aust, P.C.

(57) ABSTRACT

A throughflow cylinder made at least partly of fiber-reinforced plastic including glass fibers, aramide fibers, carbon fibers, and/or carbon-reinforced plastic (CRP). The matrix material of the fiber-reinforced plastic includes a material heat resistant at least up to 300° C. such as a resin. At least one fiber layer is provided such that the coefficient of thermal expansion $\alpha$ of the fiber-reinforced plastic is lower than that of steel at approximately 300° C. and preferably lies in a region of $0 \leqq \alpha < 9 \cdot 10^{-6} \cdot 1/\text{Kelvin}$. The manufacture of the fiber-reinforced plastic, for example carbon fiber-reinforced plastic, is such that more than approximately 30%, in particular more than approximately 50% and preferably more than approximately 70% of the fibers are oriented at least substantially in the peripheral direction.

15 Claims, 4 Drawing Sheets

THROUGHFLOW CYLINDER

CROSS REFERENCE TO RELATED APPLICATIONS

This is a continuation of PCT application No. PCT/EP02/04987, entitled "THROUGH-FLOW CYLINDER", filed May 6, 2002.

BACKGROUND OF THE INVENTION

1. Field of the Invention

The present invention relates to a throughflow cylinder for a throughflow drying unit, in particular for tissue.

2. Description of the Related Art

An example of a throughflow cylinder is recited in an article "Hightech Durchströmtrocknung für Tissue" (High-tech Throughflow Drying For Tissue) of Fleissner GmbH in ipw 3/2001, page 21.

The previously known throughflow cylinders, also called TADs (through air drying) cylinders, consist of metal. The tissue web is guided on a screen over the throughflow cylinder. A gaseous medium is pressed through the tissue web by way of the throughflow cylinder. This gaseous medium or fluid can have a temperature of more than 300° C. In the event of a web break, this temperature acts directly on the screen which is now no longer cooled by the tissue web. To avoid any damage to the screen as a consequence of the high temperature, the screen is cooled in a shock-like manner by way of a cold water jet tube. The throughflow cylinder is also exposed to this temperature shock, which results in extreme thermal stresses. Complex constructions are necessary to prevent the metal from tearing or to reduce the risk of tearing (see the article "Hightech Durchströmtrocknung für Tissue" (High-tech Throughflow Drying For Tissue) of Fleissner GmbH in ipw 3/2001, page 21).

What is needed in the art is an improved throughflow cylinder in which the previously named problems have been eliminated.

SUMMARY OF THE INVENTION

The present invention provides a throughflow cylinder made at least partly of fiber-reinforced plastic.

The material of the fiber-reinforced plastic can in particular contain glass fibers, aramide fibers and/or preferably carbon fibers. The throughflow cylinder can thus at least partly include carbon-reinforced plastic (CRP). The matrix material of the fiber-reinforced plastic advantageously includes a material preferably heat resistant at least up to 300° C. This material can, for example, be a resin or the like.

It is advantageous if at least one fiber layer is provided and if the fiber layer is selected such that the coefficient of thermal expansion $\alpha$ of the fiber-reinforced plastic is lower than that of steel at approximately 300° C. and preferably lies in a region of $0 \leqq \alpha < 9 \cdot 10^{-6} \cdot 1/\text{Kelvin}$. The coefficient of thermal expansion $\alpha$ of the fiber-reinforced plastic is preferably smaller than approximately $3 \cdot 10^{-6} \cdot 1/K$, in particular smaller than approximately $2 \cdot 10^{-6} \cdot 1/K$ and preferably smaller than approximately $1 \cdot 10^{-6} \cdot 1/K$ at least in the peripheral direction. This can for example be achieved in that, in the manufacture of the fiber-reinforced plastic, for example carbon fiber-reinforced plastic, expediently more than approximately 30%, in particular more than approximately 50% and preferably more than approximately 70% of the fibers are oriented at least substantially in the peripheral direction.

It is, however, unfavorable that the bending stiffness of the related cylinder becomes very small. Such a fiber layer is accordingly not possible, for example, with guide rollers or smaller cylinders. The fibers in these are axially aligned in these, at least in the outermost layers (for example EP-A-0 363 887). In accordance with a preferred embodiment of the throughflow cylinder in accordance with the present invention, the cylinder diameter is therefore $\geqq 2.5$ m, in particular>4 m and preferably>4.5 m, whereby a sufficient bending stiffness is ensured even with wide tissue machines larger than 5 m.

The throughflow cylinder of the present invention can generally include a jacket, end-face covers with bearing spigots and, at least at one side, preferably the driving side, a fluid outlet stub, for example air outlet stubs. Optionally, a supply stub or a fluid supply opening can be provided instead. A suction box or a blower box can appropriately be provided at the interior of the throughflow cylinder and drying fluid, for example drying air, can be led off or supplied through this. The suction box or the blower box can at least substantially cover the region or sector of the throughflow cylinder which the web wraps around, whereby secondary air or inleaked air is avoided. Alternatively, the non-wrapped region can also be covered, e.g. by a cover metal sheet, for the avoidance of secondary air.

In accordance with a preferred practical embodiment of the present invention, at least the jacket of the throughflow cylinder includes fiber-reinforced plastic, preferably of carbon fiber-reinforced plastic (CRF). The fibers preferably have a smaller coefficient of thermal expansion than the plastic at least in one direction.

The jacket can, for example, be made of individual elements. A preferred practical embodiment of the throughflow cylinder in accordance with the present invention is characterized in that it includes webs, in particular ring-shaped webs, extending in the peripheral direction and webs extending in the axial direction; in that the webs extending in the peripheral direction include fiber-reinforced plastic whose fibers are mainly oriented in the peripheral direction; and in that the webs extending in the axial direction include metal and are preferably provided with recesses for the webs extending in the peripheral direction.

Since the fibers of the fiber-reinforced plastic of the webs extending in the peripheral direction are mainly oriented in the peripheral direction, a smaller coefficient of thermal expansion a results in the peripheral direction. The webs extending in the peripheral direction are preferably adhesively bonded to the webs extending in the axial direction. Since the webs made of metal and extending in the axial direction can expand on a corresponding change of temperature, the throughflow cylinder is expediently provided with a floating bearing in order to take up the corresponding axial displacements.

An advantageous alternative embodiment of the throughflow cylinder in accordance with the present invention includes webs, in particular ring-shaped webs, extending in the peripheral direction and webs extending in the axial direction; in that both the webs extending in the peripheral direction and the webs extending in the axial direction in each case include fiber reinforced plastic; and in that the webs extending in the peripheral direction and the webs extending in the axial direction are connected to one another in a shape matched manner and are preferably adhesively bonded to one another.

The fibers in the webs extending in the peripheral direction are preferably oriented in the peripheral direction and the fibers in the webs extending in the axial direction are preferably oriented in the axial direction, which brings about a high bending stiffness for the throughflow cylinder. The jacket is expediently provided with four-cornered, in particular square, or preferably rectangular passage openings. These passage openings can in particular be formed between the webs. The open area preferably lies in a range from approximately 95% to 98%. Preferred dimensions of the openings are 60 mm×120 mm.

It is advantageous in certain cases for the webs extending in the axial direction to be higher than the webs extending in the peripheral direction. In this manner, in accordance with an expedient alternative embodiment of the throughflow cylinder in accordance with the present invention, the webs extending in the axial direction can project radially outwardly with respect to the webs extending in the peripheral direction. In this case, the throughflow screen lies on the webs extending in the axial direction.

The throughflow cylinder can, for example, include segments which are glued together and/or screwed together. It is also conceivable that it includes individual short cylindrical sections which can for example be glued together or screwed together. An advantage resulting from this is that a smaller autoclave is sufficient for the curing process.

It is also possible that both the webs extending in the peripheral direction and the webs extending in the axial direction end in the circumferential plane of the throughflow cylinder. In this case, the throughflow screen, also called a TAD (through air drying) screen, lies on the webs extending in the peripheral direction and on the axial webs. The throughflow cylinder can be covered with a screen stocking to homogenize the flow of the gaseous medium, for example air, passing through and to thereby avoid marks. This is particularly advantageous when the open area is smaller than 96%. The screen stocking can include, for example, a material, for example metal, which is preferably heat resistant at least up to 250° C. The webs extending in the axial direction and the webs extending in the peripheral direction can have apertures which allow cross-flows and thus homogenize the flow.

In a further expedient embodiment of the present invention, the jacket of the throughflow cylinder includes layers of fiber-reinforced plastic in particular produced using the winding process. It can be provided, for example, with round, square and/or rectangular passage openings. The openings can be cut-out during the manufacturing process (e.g. winding process) or be produced subsequently in a cutting process, i.e. in particular by drilling and/or milling.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
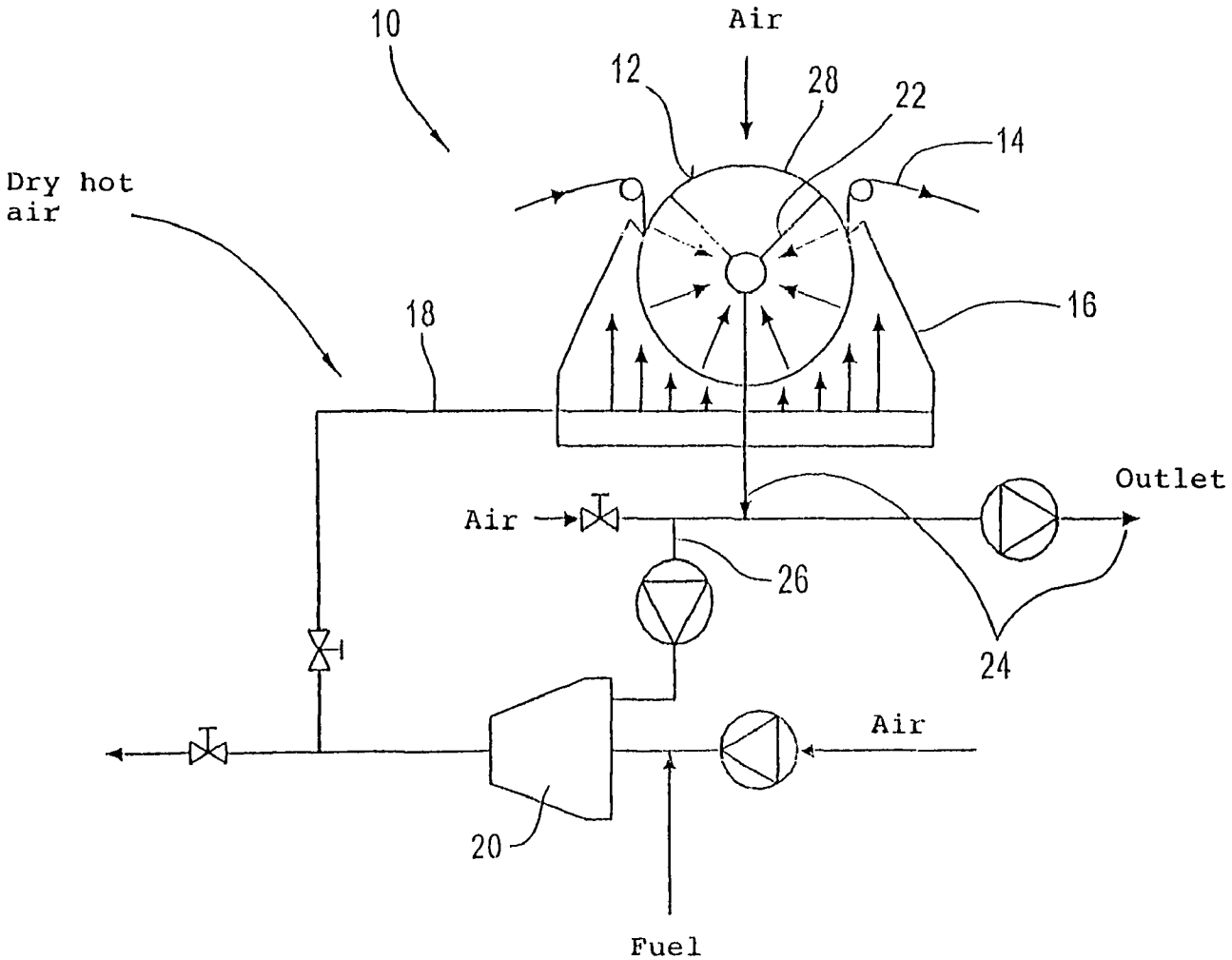
FIG. 1 is a schematic view of an embodiment of a throughflow drying unit, in particular for tissue, with a throughflow cylinder in accordance with the present invention.

Referring now to the drawings, and more particularly to FIG. 1, there is shown a throughflow drying unit 10, in particular for tissue. Throughflow drying unit 10 includes throughflow cylinder 12 around which throughflow screen 14 is guided. A tissue web is guided around throughflow cylinder 12 together with throughflow screen 14.

Hood 16 is associated with throughflow cylinder 12 and, in the present case, dry hot air supplied from burner 20 is delivered to it via line 18. A suction box or a blower box can be provided at the interior of the throughflow cylinder and the drying air can be led off or supplied through it. In the present case, suction box 22 is provided at the interior of throughflow cylinder 12. The mixture of hot air and steam is led off via lines 24. Some of this mixture can also be supplied back to burner 20 via line 26.

Figure 2:
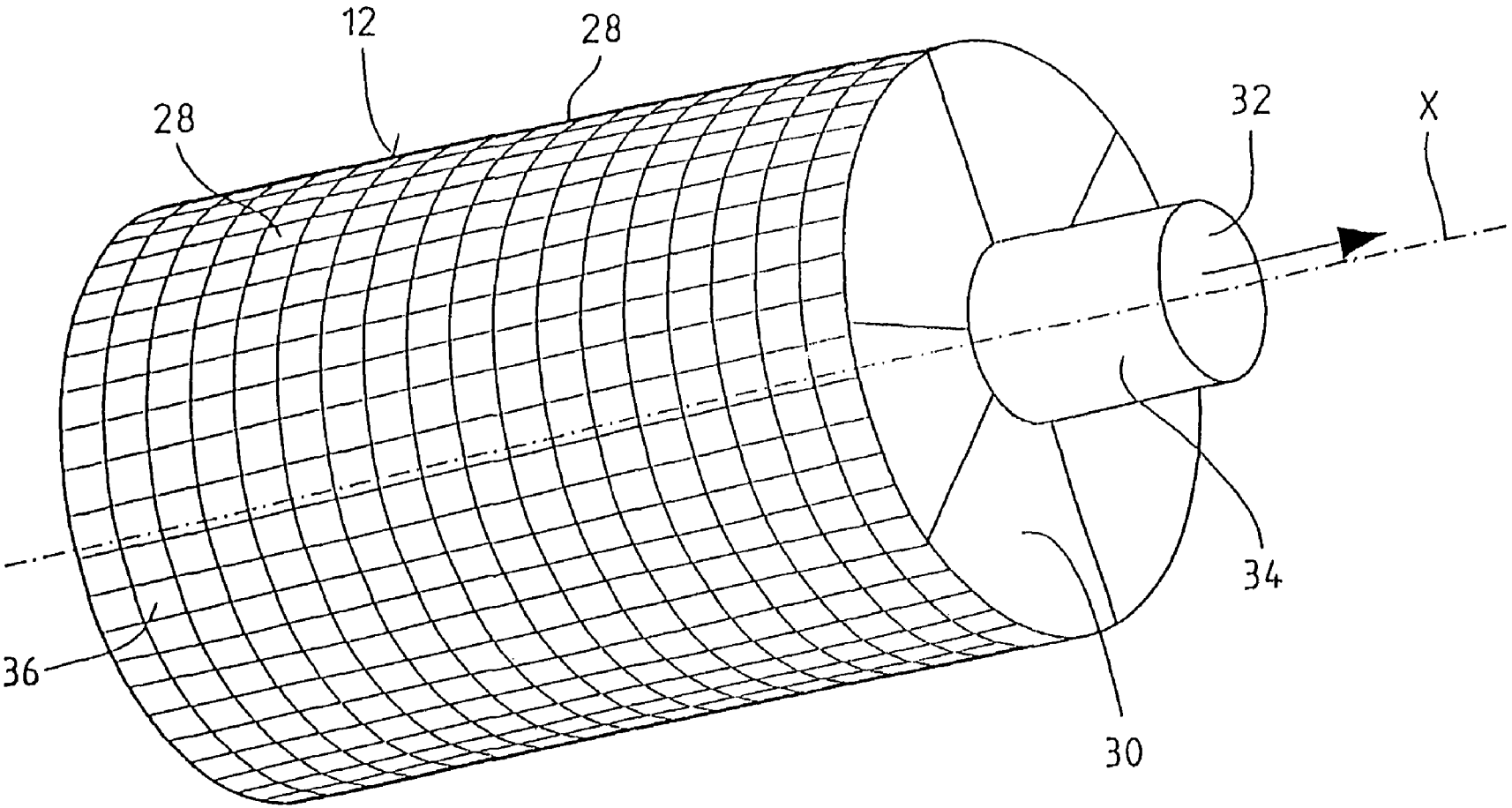
FIG. 2 is a perspective view of the throughflow cylinder of FIG. 1.

As can in particular also be recognized with reference to FIG. 2, throughflow cylinder 12 includes jacket 28, end-face covers 30 and, at least at one side, preferably the driving side, extraction opening 32 for moist hot air. In the present case, this extraction opening is provided in the respective bearing spigot 34. The axis of throughflow cylinder 12 is indicated by "X" in FIG. 2. Surface 28 of the throughflow cylinder 12 is provided with throughflow openings 36.

At least jacket 28 of throughflow cylinder 12 includes, at least partly, fiber-reinforced plastic. The material of the fiber-reinforced plastic can contain, for example, glass fibers, aramide fibers and/or preferably carbon fibers. Jacket 28 can thus include at least partly, in particular, carbon fiber-reinforced plastic (CRP).

Figure 3:
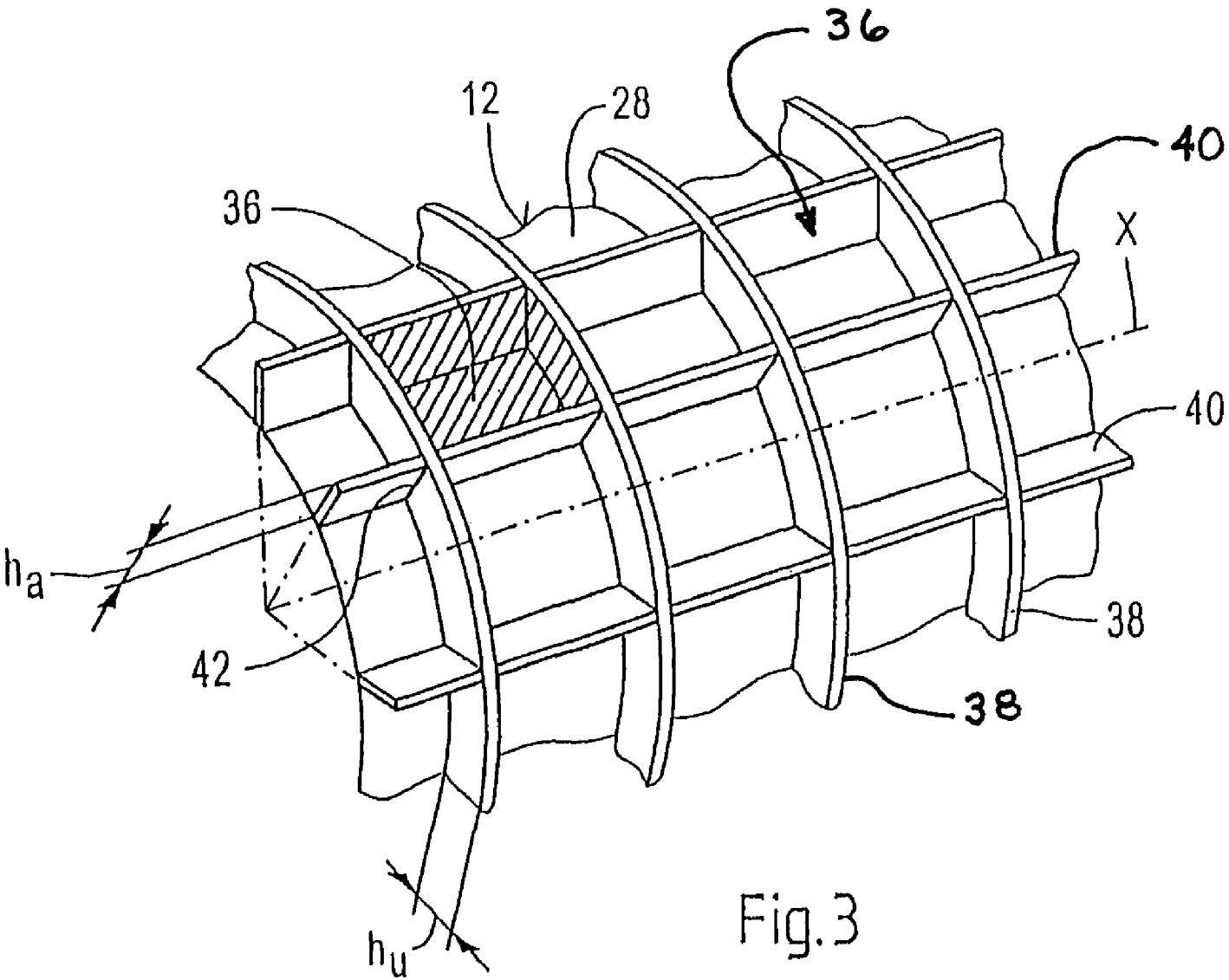
FIG. 3 is a perspective fragmentary view of the jacket of an embodiment of the throughflow cylinder of the present invention manufactured from a plurality of individual elements.

FIG. 3 shows a schematic section of jacket 28 of an embodiment of throughflow cylinder 12 of the present invention manufactured from a plurality of individual parts. Jacket 28 includes webs, in particular ring-shaped webs 38, extending in the peripheral direction and webs 40 extending in the axial direction. Such a design is, for example, feasible in which webs 38 extending in the peripheral direction include fiber-reinforced plastic whose fibers are mainly oriented in the peripheral direction and webs 40 extending in the axial direction include metal and are preferably provided with cut-outs 42 for webs 38 extending in the peripheral direction. Webs 38 extending in the peripheral direction can be adhesively bonded to webs 40 extending in the axial direction. A floating bearing can be associated with the webs 40 extending in the axial direction.

However, such a design is also possible in which both webs 38 extending in the peripheral direction and webs 40 extending in the axial direction each include fiber-reinforced plastic and webs 38 extending in the peripheral direction and webs 40 extending in the axial direction are connected to one another in a shape matched manner and are preferably adhesively bonded to one another. In the latter case, the fibers in webs 38 extending in the peripheral direction are preferably oriented in the peripheral direction and the fibers in webs 40 extending in the axial direction are preferably oriented in the axial direction. Jacket 28 can be provided with four-cornered, in particular square or preferably rectangular passage openings 36 which can be formed in the present case between webs 38, 40.

In FIG. 3, the height of webs 38 extending in the peripheral direction is given as $h_u$ and the height of webs 40 extending in the axial direction is given as $h_a$. As already initially mentioned, these heights $h_u$ and $h_a$ can be of equal size or also of different size. Webs 40 extending in the axial direction can thus, for example, be higher than webs 38 extending in the peripheral direction. To increase the bending stiffness, the heights $h_a$ of the axial webs 40 can be larger than approximately 100 mm, preferably larger than approximately 200 mm. If webs 40 extending in the axial direction project radially outwardly with respect to webs 38 extending in the peripheral direction, throughflow screen 14 (FIG. 1) lies on webs 40 extending in the axial direction. It is, however, also conceivable for both webs 38 extending in the peripheral direction and webs 40 extending in the axial direction to end in the circumferential plane such that throughflow screen 14 lies on webs 38 extending in the peripheral direction and on axial webs 40.

Figure 4:
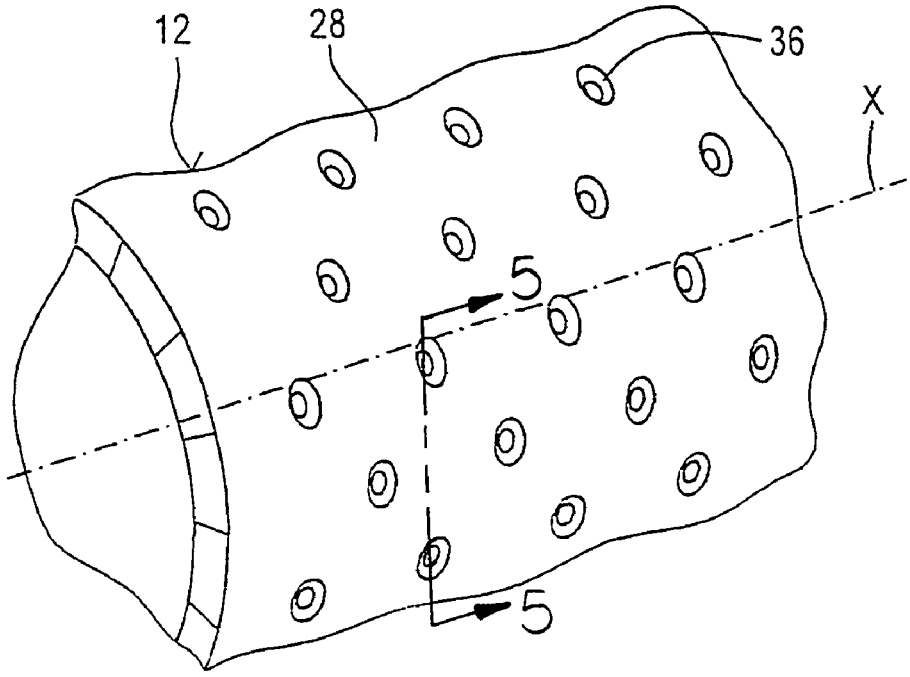
FIG. 4 is a perspective fragmentary view of the jacket of an embodiment of the throughflow cylinder of the present invention in which the jacket includes layers of fiber-reinforced plastic in particular produced using the winding process and is provided with, for example, round passage openings.

FIG. 4 shows a schematic section of jacket 28 of an embodiment of throughflow cylinder 12 in which jacket 28 includes layers of fiber-reinforced plastic produced in particular using the winding process and is provided with, for example, round, square and/or rectangular passage openings, in the present case round passage openings 36. Connection passages can be provided between adjacent bores or passage openings for the homogenizing of the flow.

Figure 5:
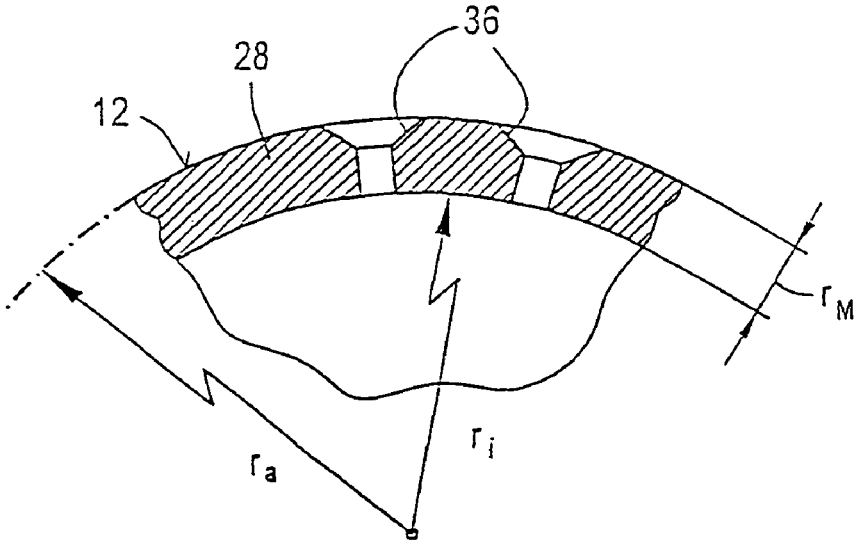
FIG. 5 is a cross-sectional view through the cylinder jacket shown in FIG. 4 taken along section line 5-5.

As can in particular also be recognized with reference to FIG. 5, which shows a schematic section through cylinder jacket 27 shown in FIG. 4, passage openings 36 can be countersunk. In FIG. 5, the external radius of jacket 28 is given as "$r_a$" and the internal radius is given as "$r_i$". The radial thickness jacket 28 is designated as "$r_M$". This can in particular be$\geqq$100 mm and preferably$\geqq$200 mm.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

REFERENCE CHARACTER LIST

10 throughflow drying unit
12 throughflow cylinder
14 throughflow screen
16 hood
18 line
20 burner
22 suction box
24 line
26 line
28 jacket
30 end-face cover
32 extraction opening
34 bearing spigot
36 passage opening
38 web extending in the peripheral direction
40 web extending in the axial direction
42 cut-out
$h_a$ height of a web extending in the axial direction
$h_u$ height of a web extending in the peripheral direction
$r_a$ external diameter of the jacket
$r_i$ internal diameter of the jacket
$r_M$ jacket thickness

What is claimed is:

1. A throughflow cylinder for drying a fiber web in a throughflow drying unit, said throughflow cylinder being comprised of fiber-reinforced plastic, further including a plurality of webs extending in a circumferential direction and a plurality of webs extending in an axial direction, said plurality of webs extending in a circumferential direction including said fiber-reinforced plastic having a plurality of fibers that are substantially oriented in said circumferential direction, said plurality of webs extending in an axial direction including metal, said plurality of webs extending in an axial direction including cutouts for said plurality of webs extending in a circumferential direction.

2. The throughflow cylinder of claim 1, wherein said plurality of webs extending in a circumferential direction are ring-shaped.

3. The throughflow cylinder of claim 1, wherein said plurality of webs extending in a circumferential direction are adhesively bonded to said plurality of webs extending in an axial direction.

4. The throughflow cylinder of claim 1, further including a floating bearing connected to said throughflow cylinder.

5. The throughflow cylinder of claim 1, further including a jacket having a plurality of four-cornered passage openings.

6. The throughflow cylinder of claim 5, wherein said plurality of four-cornered passage openings are a plurality of square passage openings.

7. The throughflow cylinder of claim 5, wherein said plurality of four-cornered passage openings are a plurality of rectangular passage openings.

8. The throughflow cylinder of claim 5, wherein said plurality of four-cornered passage openings are formed between said plurality of webs extending in a circumferential direction and said plurality of webs extending in an axial direction.

9. The throughflow cylinder of claim 5, wherein an open area of said plurality of four-cornered passage openings is between approximately 95% and 98%.

10. The throughflow cylinder of claim 5, wherein at least one of said plurality of four-cornered passage openings measures approximately 60 mm by 120 mm.

11. The throughflow cylinder of claim 1, wherein said plurality of webs extending in an axial direction are at least one of equal and higher than said plurality of webs extending in a circumferential direction.

12. The throughflow cylinder of claim 1, wherein both said plurality of webs extending in a circumferential direction and said plurality of webs extending in an axial direction end in a circumferential plane.

13. The throughflow cylinder of claim 1, wherein said plurality of webs extending in an axial direction project radially outwardly respective to said plurality of webs extending in a circumferential direction.

14. The throughflow cylinder of claim 1, wherein said plurality of webs extending in an axial direction include a height, said height is greater than approximately 100 mm.

15. The throughflow cylinder of claim 14, wherein said height is greater than approximately 200 mm.

* * * * *

UNITED STATES PATENT AND TRADEMARK OFFICE

CERTIFICATE OF CORRECTION

PATENT NO. : 7,331,120 B2
APPLICATION NO. : 10/712608
DATED : February 19, 2008
INVENTOR(S) : Scherb et al.

It is certified that error appears in the above-identified patent and that said Letters Patent is hereby corrected as shown below:

COLUMN 2

At line 46, please delete "expansion a results", and substitute therefore --expansion α results--.

Signed and Sealed this

Fourteenth Day of October, 2008

JON W. DUDAS
*Director of the United States Patent and Trademark Office*